United States Patent [19]

Ehrlund

[11] 4,047,652

[45] * Sept. 13, 1977

[54] TICKET DISPENSING ASSEMBLY FOR DISPENSING TICKETS FROM A FLEXIBLE STRIP

[76] Inventor: Ake Ehrlund, Alvkvarnsvagen 177, Spanga, Sweden

[ * ] Notice: The portion of the term of this patent subsequent to May 27, 1992, has been disclaimed.

[21] Appl. No.: 703,313

[22] Filed: July 7, 1976

Related U.S. Application Data

[62] Division of Ser. No. 520,865, Nov. 4, 1974, which is a division of Ser. No. 326,457, Jan. 24, 1973, Pat. No. 3,885,724.

[30] Foreign Application Priority Data

Jan. 26, 1972 Sweden ..... 846/72

[51] Int. Cl.[2] ..... B26F 3/02

[52] U.S. Cl. ..... 225/54; 225/77; 225/90

[58] Field of Search ..... 225/39, 25, 26, 53, 225/77, 80, 88, 90, 91, 54

[56] References Cited

U.S. PATENT DOCUMENTS 2,361,528 10/1944 Beloud ..... 225/90 X 3,007,619 11/1961 Burcz ..... 225/90 X 3,039,664 6/1962 Harrison et al. ..... 225/54 X

*Primary Examiner*—Frank T. Yost

*Attorney, Agent, or Firm*—Allison C. Collard

[57] ABSTRACT

A ticket dispensing assembly for dispensing tickets from a flexible strip is described having a container made up of a casing and a cover containing a roll comprising a strip of flexible material the end of which protrudes from the container. The strip has a series of penetrated lines spaced longitudinally along the strip with each line forming an individual tongue shaped flap extending from adjacent one marginal edge portion of the strip to adjacent the other marginal edge portion of the trip and projecting forwardly in the feeding direction of the strip. The container includes means for guiding the strip and a tear-off portion where the most forward ticket of the strip is torn off from the strip, the guiding means including a tongue having a shape corresponding to that of the bottom of the strip flap in order to, during passage of the strip, first guide the strip along a predetermined path and then to guide the flap over the tongue along one path and the remainder of the strip along another path, the last mentioned path leading to the tear-off means which are arranged to tear off the forward most ticket from the remainder of the strip at the marginal strip portions.

7 Claims, 6 Drawing Figures

FIG. 4
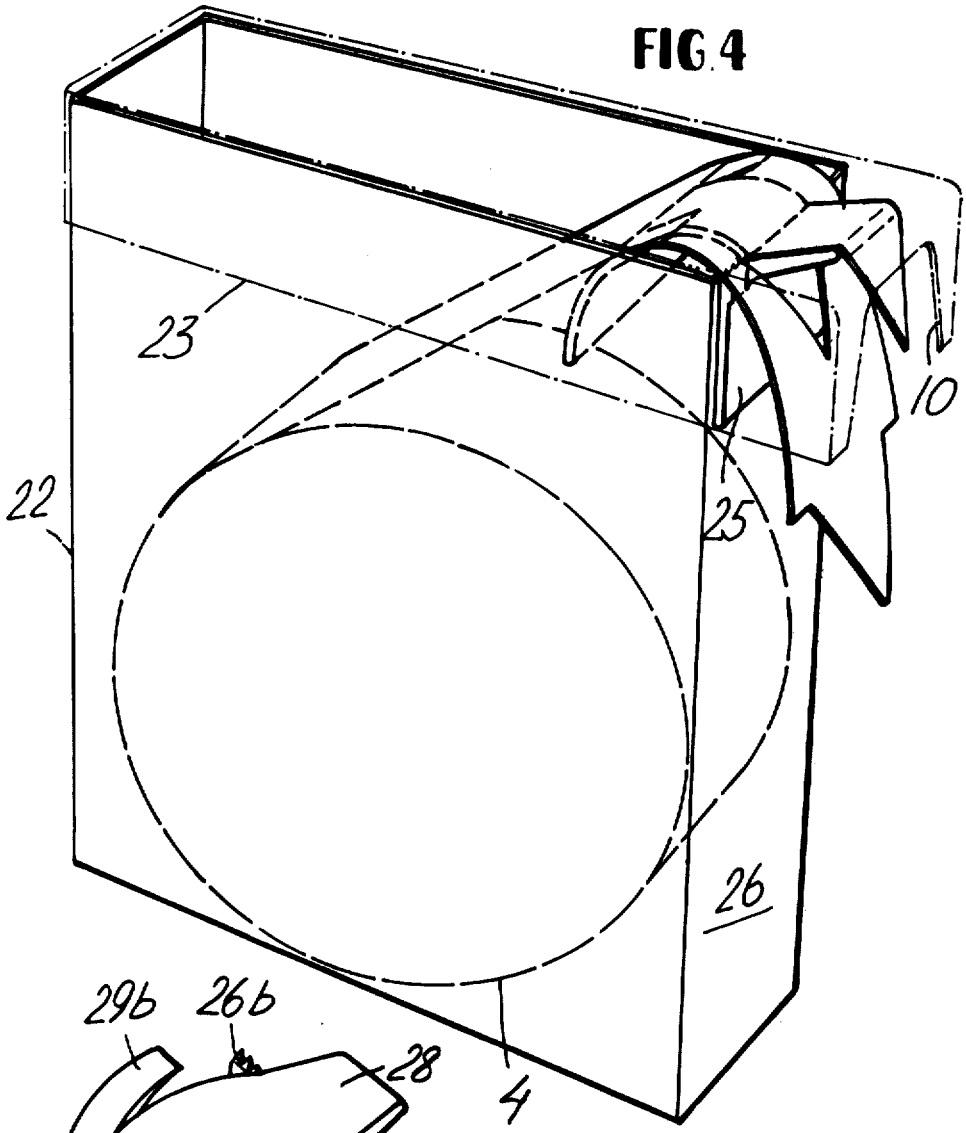
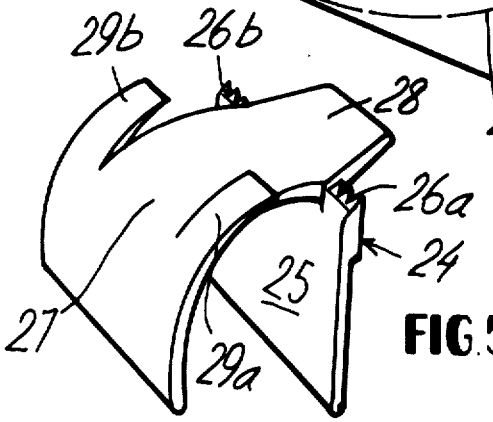
FIG. 5

TICKET DISPENSING ASSEMBLY FOR DISPENSING TICKETS FROM A FLEXIBLE STRIP

This application is a division of copending application Ser. No. 520,865 filed Nov. 4, 1974, which in turn is a divisional application of Ser. No. 326,457, filed Jan. 24, 1973 (claiming priority of Jan. 26, 1972 by Swedish Application No. 846/72), now U.S. Pat. No. 3,885,724 issued May 27, 1975.

This invention relates to appliances which comprise a strip provided with perforations or punched lines, which strip is fed forward and is torn off by means of a pull at that end of the strip which is at that time the free end.

However, such known appliances which are used primarily for the issue of queuing and similar tickets are not as reliable in operation as one has the right to expect.

The object of this invention has therefore primarily been the creation of a device which is particularly reliable in operation and also has a simple construction.

In order to accomplish these and other aims, the device is designed in accordance with the claims. The ticket dispensing assembly for dispensing tickets from a flexible strip in accordance with this invention includes a container made up of a casing and a cover containing a roll comprising a strip of flexible material the end of which protrudes from the container. The strip has a series of penetrated lines spaced longitudinally along the strip with each line forming an individual tongue shaped flap extending from adjacent one marginal edge portion of the strip to adjacent the other marginal edge portion of the strip and projecting forwardly in the feeding direction of the strip. The container includes means for guiding the strip and a tear-off portion where the most forward ticket of the strip is torn off from the strip, the guiding means including a tongue having a shape corresponding to that of the bottom of the strip flap in order to, during passage of the strip, first guide the strip along a predetermined path and then to guide the flap over the tongue along one path and the remainder of the strip along another path, the last mentioned path leading to the tear-off means which are arranged to tear off the forward most ticket from the remainder of the strip at the marginal strip portions.

Three constructional versions of the invention are shown as examples in the attached drawings.

FIG. 4 shows in perspective a second constructional version of the invention, in which the casing and/or the cover may by of the throw-away type.

FIG. 5 shows in perspective a plastic component, most conveniently made by injection moulding, which forms part of the constructional version according to FIG. 4.

Figure 1:
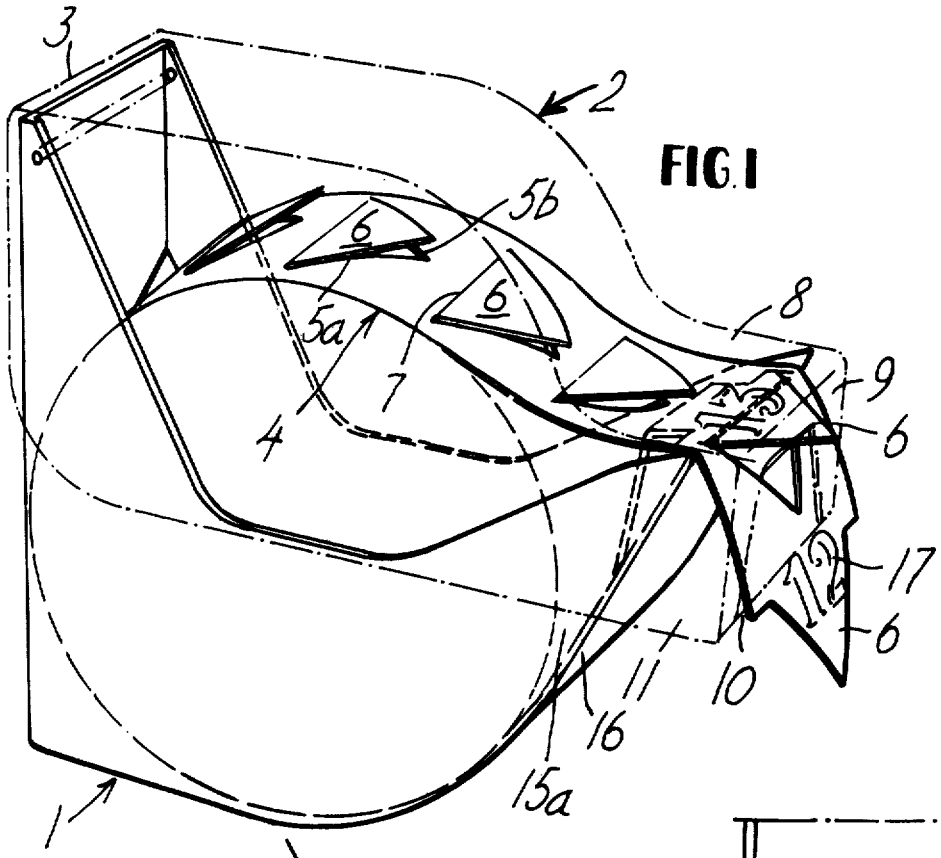
FIG. 1 shows a perspective view of a first constructional version of the invention, with the casing indicated by chain lines.

In the FIG. 1 denotes the casing of the appliance while 2 denotes a cover which is joined to the casing by means of a pivot 3, about which it may be raised and lowered. Together, the casing and the cover form, at the side which is on the right in the Figure, a guide for the discharge of a flexible strip material or strip placed in the casing in the shape of a roll which has the general designation 4. This strip, which is most appropriately made of paper, is punched through along lines 5*a*, 5*b* at a regular spacing so as to form a number of flaps 6 which, as shown in the Figure, have the property that their width is least at the free end and largest at the end 7 which is connected to the rest of the strip. With this regular spacing each flap will be part of a different ticket piece or strip piece and the longitudinal spacing between corresponding portions of adjacent flaps will be equal to this regular spacing. The connected end 7 of each flap extends laterally of the strip perpendicular to the longitudinal direction of the strip and extends from a marginal strip portion adjacent one marginal edge of the strip to a marginal strip portion adjacent the other marginal edge of the strip with the marginal strip portions connecting the different ticket pieces of the strip. In this connection, it may be pointed out that it is not necessary for these flaps to be completely punched out as shown in the Figure, but that it is possible to replace the punched lines by lines of perforation.

The casing and the cover are constructed so that together they form a discharge and tear-off device for the strip. To this end, the cover 2 has a portion 8, the orientation of which may be parallel to a tangent to the roll which the strip 4 forms. This portion is connected to a portion 9 in which there is a slot 10 open at the bottom, which portion 9 is substantially at right angles to the portion 8 and is directed downwards. The portions 8 and 9 constitute one part of a guidance device for the strip.

Figure 2:
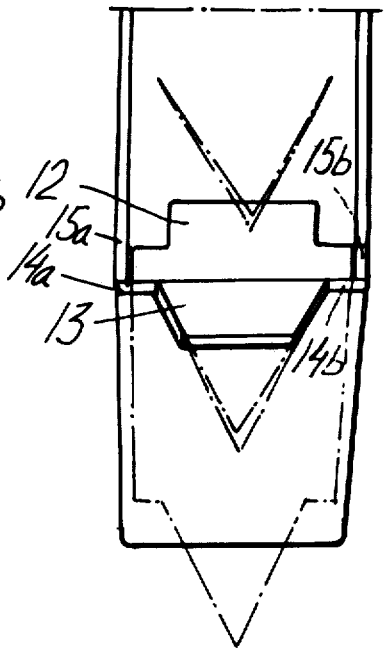
FIG. 2 shows the discharge portion of the casing, viewed from the free end of the strip, the cover being raised.

The second part of the said guidance device is formed by the casing which for this purpose exhibits a first portion 12 which, in the position in which the device is used, is substantially parallel to the portion 8 but is situated at some distance from this, so that there is between these parts a gap through which the strip can pass. The part 12, as seen in FIG. 2, is connected to a tongue 13 which is substantially an extension of the part 12. The greatest width of the tongue 13 which, as seen in the Figure, is appropriately wider at its base than at its free end, is less than the greatest width of the flaps 6. The tongue extends almost up to the inside of the portion 9 of the cover which is pointing downwards, i.e. in such a way that there is formed a gap through which the strip can pass. At its base, the tongue is connected by means of portions 14*a*, 14*b*, which are constructed as tear-off devices, to the side walls 15*a*, 15*b* of the casing which, together with the tongue 13, constitute the second portion of the said guide.

In the position in which it is used, the cover 2 is lowered over the casing as shown in FIG. 1. The strip has been passed through the horizontal guide formed by the surfaces 8, 12 and the upper parts of 15*a*, 15*b* and through the vertical guide formed by the surface 9, the end portion of the tongue 13 and guide projections, not shown, on the inside of the side faces 11 of the cover.

Figure 3:
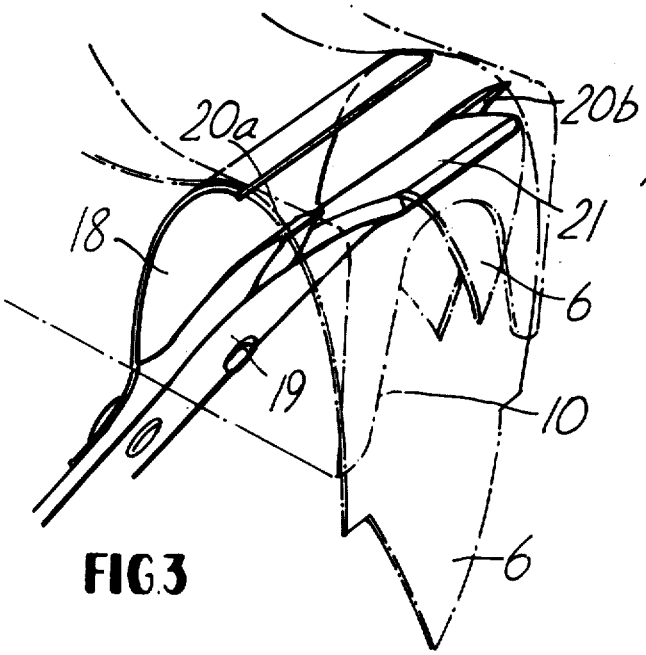
FIG. 3 shows a somewhat modified constructional version of the invention, the cover of the casing being indicated by chain lines.

When it is desired to tear off a queuing ticket, the clap 6 is to be gripped and the strip pulled downwards by means of this. The causes the strip to move first horizontally and then vertically. When the strip has been pulled forward so far that the width of the opening formed by the punched lines 5*a*, 5*b* exceeds the width of the tongue 13, the strip itself will be deflected in such a way that in its final position, as shown in FIG. 1, in which the width of the flap 6 is practically the same as that of the tongue 13 at its base, the strip is deflected about this base portion. It will be clear that, as the strip continues to be pulled downwards, it will be torn off by the cutting edges 14a, 14b provided for this purpose. If the slot 10 in the front wall of the cover had extended right up to the top of the cover, the flap 6 would not have been deflected but, as shown in FIG. 1, would have projected in the direction of the tangent. For the reliable operation of the device, however, it is important that the strip should be subjected to a downward pull, and for this reason the slot 10 ends some distance below the tongue 13, thus converring on the flap 6 its vertical orientation, e.g. as shown in FIG. 3. By virtue of the fact that there is a space between the front wall 16 of the casing and the inside of the front wall of the cover, the flap fed forward is readily accessible. When the queuing ticket, which thus consists of a flap 6 and strip material up to the next flap, has been torn off, the strip is again in its initial position and a new queuing ticket can immediately be drawn forward. Naturally, the strip can in a known manner to be provided with the desired wording and a queuing number, ticket number or similar 17. It is also possible, for instance, to provide two flaps in the shape of right-angled triangles situated side by side and facing opposite ways, etc.

In the constructional version according to FIG. 3, the lower horizontal guide for the strip does not consist of continuous parts but is made up of a preferably resilient rear tongue 18 which is attached to the inside of the casing 1 or is made integral with this, and a front part 19 which is appropriately part of the front wall of the casing and comprises the cutting edges 20a, 20b corresponding to the edges 14a, 14b in FIG. 1 and a tongue 21 corresponding to the tongue 13, but, contrary to this, positioned at an angle. The upper parts of the tongues 18, 21 will thus form the bottom part of the horizontal guide for the strip. The cutting edges 20a, 20b are situated at a level below this. In this constructional version, especially if the tongue 18 is made of a resilient material, the tongue can abut onto the part 8, and by pressing the strip against this part 8, can give rise to a frictional force which prevents unintentional retraction of the strip into the casing.

The invention also makes possible production of discharge appliances at an extremely low cost, whereby the whole appliance or part thereof may consist of a throw-away article. Such a device, particularly designed for the sale of tickets at sporting and similar events, is shown in FIG. 4.

In this constructional version the casing consists of a simple cardboard box 22. This box at the same time serves as a container for the strip 4 which, as in the constructional version described earlier, is appropriately in the shape of a roll and is made in the same way. The box is closed by a cover 23 which extends outside the box and has a slot 10 in one of its end walls.

An injection moulded part 24 is attached to the cover and the two parts together serve as the guides for the strip. The component comprises a first flat portion 25 which is to abut onto one front wall 26 of the box. At the top of the flat portion 25, as shown in FIG. 5, there are two cutting edges 26a, 26b separated in the lateral direction, and between these the portion 25 is joined to a portion 27 which is bent in an are downwards and backward, end a tongue 28 extending forwards and upwards. The arcuate portion 27 is provided with resilient projections 29a, 29b which are directed upwards and are also arcuate, the top parts of which are situated at approximately the same level as the top part of the tongue 28 and press the strip against the cover by a spring force. The cutting edges 26a, 26b are situated at a lower level. The method of operation of this device is in complete agreement with that described earlier.

Figure 6:
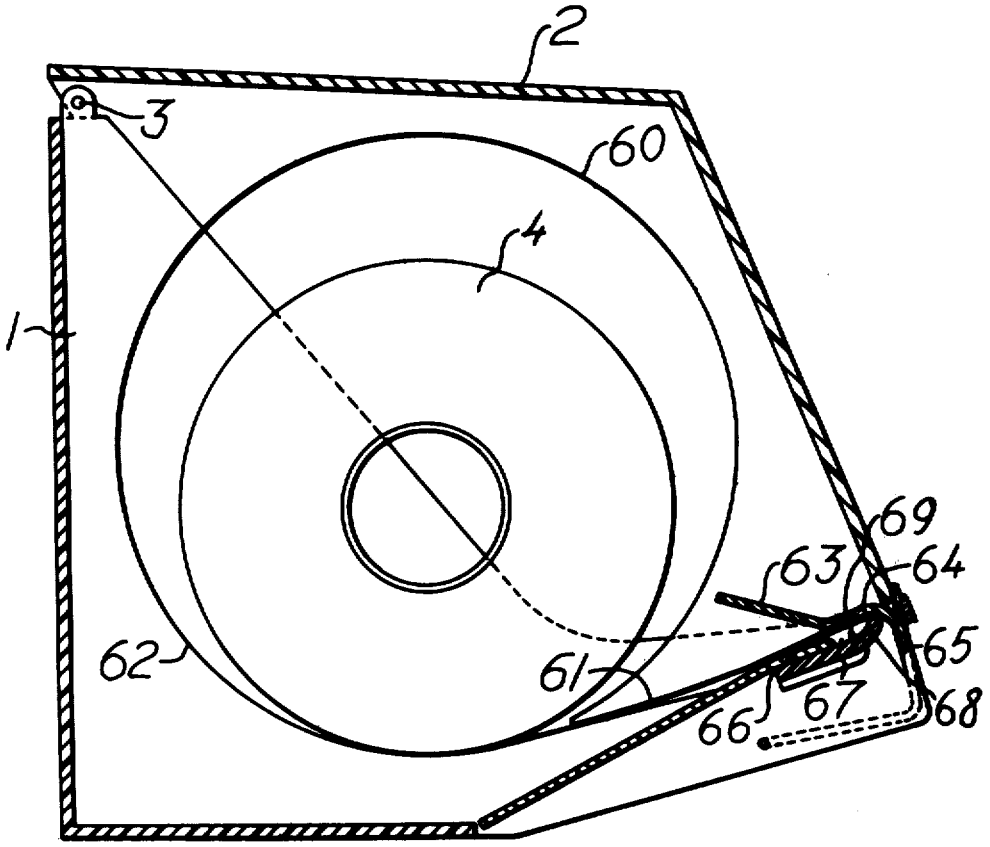
FIG. 6 shows in a side view and partly in section a third embodyment of the device according to the invention.

In the embodyments according to FIG. 1 and 4 the strip roll is unrolled clockwise whereas in FIG. 6, the strip roll is unrolled counter-clockwise. The discharge device according to FIG. 6 has semicircular guide means 60, arranged inside the cover 2. The end 61 of said guide means 60 extend below the front end of said cover end form front steps for the strip roll. The casing 1 carries correspondingly formed guide means 62 and from FIG. 6 it is obvious that the strip roll rests against the guide means 62. Said guide means 60, 62 constitute a support for the strip roll as well as limiting surfaces for said strip roll.

The discharge and cut off means for the strip according to the embodyment in FIG. 6 constitutes a portion arranged inside the front part of the cover 2 and consisting of a slightly directed, inner portion 63, transcending into a curved part 64 and terminating in a downwardly directed portion 65, extending below the front part of the cover 2. The guiding means arranged in the casing constitutes a inclined path 66 transcending in its front part into a upwardly directed tongue 68 via a shoulder 67. The tongue 68 has the generally shaping and function of e.g. the tongue 13 in FIG. 2, thus having edges 69 forming tear off devices.

The guiding means bear on or almost bear on the upside of the strip 4. A narrow discharge gap is formed between the guide means 65 of cover 2 and the upwards directed front part of the tongue 68. The function of this embodyment is exactly in accordance with the example of FIG. 1 and 4. Thus, by pulling the flap 6, the strip roll will be discharged and forces the strip, subject to the pulling force in such way, that said strip will automatically be torn off against the edges 69, simultaneously the flap of the next strip will be turned down due to the guide means 64, 65. When the first mentioned flap has been torn off, the flap of the next strip is uncovered and can easily be gripped.

The invention can naturaly be varied also in other respects within the framework of the following claims.

I claim:

1. A ticket dispensing assembly for dispensing tickets from a flexible strip comprising:

a container comprising a casing and a cover pivotally connected with said casing and a roll of flexible strip material positioned in said container with the end of said strip protruding from said container and from which ticket pieces are intended to be torn off, said strip roll comprising a strip of flexible material from which single pieces of one and the same predetermined length are intended to be torn off and having a pair of marginal edges and a feeding direction away from said roll, said strip having a series of longitudinally spaced apart penetrated lines, each of said lines shaped and adapted to form an individual tongue shaped flap, each of said lines starting from a point adjacent to but spaced inwardly of said strip from one of said marginal edges extending in said feeding direction of said strip toward the centerline thereof, and on the other side of said centerline extending back opposite said feeding direction of said strip to a point adjacent to but spaced inwardly from the other marginal edge of said strip, said flaps equally spaced longitudinally along said strip with the longitudinal spacing between corresponding portions of adjacent flaps equal to said predetermined length, the points at the ends of each of said penetrated lines lying on a straight line which is substantially perpendicular to the longitudinal direction of the strip and with each flap firmly connected to the remainder of said strip along said straight line between said points, the end of each of said flaps remote from said firmly connected portion having a width smaller than that of said firmly connected portion and with the smaller end of each flap directed forwards in said feeding direction of said strip and dimensioned to be gripped for pulling the strip and tearing a single end piece from said strip, and marginal strip portions at both sides of each flap between the end points of said penetrated line and the adjacent marginal edges of said strip and connecting all of said pieces of predetermined length in said strip, first guidance means being combined with said cover, and second guidance means and tear-off means being combined with said casing, said second guidance means including a separation tongue located at the strip exit point, said tear-off means being located on both sides of said second guidance means and extending from the base of said separation tongue laterally outwardly beyond the marginal edges of said strip, and said separation tongue having a shape corresponding to the shape of the bottom part of said flaps in order to, during passage of the strip in response to a pull on the end of said strip protruding from said assembly, first guide the strip along a predetermined path between said first and second guidance means and then guide the flap over said separation tongue along one path and the remainder of the strip along another path, said last-mentioned path leading to the tear-off means for tearing off the end ticket at said marginal portions of said strip and leaving the next adjacent flap protruding from the assembly.

2. A ticket dispensing assembly for dispensing tickets from a flexible strip comprising:

a container comprising a casing and a cover pivotally connected with said casing and a roll of flexible strip material positioned in said container with the end of said strip protruding from said container and from which ticket pieces are intended to be torn off, said strip roll comprising a strip of flexible material from which ticket pieces are intended to be torn off and having a pair of marginal edges and a feeding direction away from said roll, said strip having a series of longitudinally spaced apart punched lines, each of said punched lines shaped and adapted to form an individual tongue shaped flap free at one end from the remainder of said strip and firmly connected with said strip at the other end, each of said punched lines starting from a point adjacent to but spaced inwardly of said strip from one of said marginal edges, extending in said feeding direction of said strip and toward the centerline of said strip, and on the other side of said centerline extending back opposite said feeding direction of said strip to a point adjacent to but spaced inwardly from the other marginal edge of said strip, the points at the ends of each of said punched lines lying on straight line which is substantially perpendicular to the longitudinal direction of said strip and with the connection of the adjacent flap to the strip located along said straight line between said points, the free end of each of said flaps having a width smaller than that of said connected portion and with the smaller end of each flap directed forwards in said feeding direction of said strip and dimensioned to be gripped for pulling the strip and tearing a single end piece from said strip, and marginal strip portions at both sides of each flap between the end points of said punched line and the adjacent marginal edges of said strip and connecting all of the ticket pieces in said strip, first guidance means being combined with said cover, and second guidance means and tear-off means being combined with said casing, said second guidance means including a separation tongue located at the strip exit point, said tear-off means being located on both sides of said second guidance means and extending from the base of said separation tongue laterally outwardly beyond the marginal edges of said strip, and said separation tongue having a shape corresponding to the shape of the bottom part of said flaps in order to, during passage of the strip in response to a pull on the end of said strip protruding from said assembly, first guide the strip along a predetermined path between said first and second guidance means and then guide the flap over said separation tongue along one path and the remainder of the strip along another path, said last-mentioned path leading to the tear-off means for tearing off the end ticket at said marginal portions of said strip and leaving the next adjacent flap protruding from the assembly.

3. A ticket dispensing assembly for dispensing tickets from a flexible strip comprising:

a container comprising a casing having side walls and an open top, and a covering pivotally connected to said casing and closing said top when in pivotally closed position, a roll of flexible strip material positioned in said container with the end of said strip protruding from said container, said strip roll comprising a strip of flexible material from which single pieces of one and the same predetermined length are intended to be torn off and having a pair of marginal edges and a feeding direction away from said roll, said strip having a series of longitudinally spaced apart penetrated lines, each of said lines shaped and adapted to form an individual tongue shaped flap, each of said lines starting from a point adjacent to but spaced inwardly of said strip from one of said marginal edges, extending in said feeding direction of said strip toward the centerline thereof, and on the other side of said centerline extending back opposite said feeding direction of said strip to a point adjacent to but spaced inwardly from the other marginal edge of said strip, said flaps equally spaced longitudinally along said strip with the longitudinal spacing between corresponding portions of adjacent flaps equal to said predetermined length, the points at the ends of each of said penetrated lines lying on a straight line which is substantially perpendicular to the longitudinal direction of the strip and with each flap firmly connected to the remainder of said strip along said straight line between said points, the end of each of said flaps remote from said firmly connected portion having a width smaller than that of said firmly connected portion and with the smaller end of each flap directed forwards in said feeding direction of said strip and dimensioned to be gripped for pulling the strip and tearing a single end piece from said strip, and marginal strip portions at both sides of each flap between the end points of said penetrated line and the adjacent marginal edges of said strip and connecting all of said pieces of predetermined length in said strip, said cover having an outwardly extending portion and another portion integral with said first-mentioned outwardly extending portion and extending in a downwardly direction relative to said cover, said casing having a portion extending substantially parallel to said first-mentioned outwardly extending portion of said cover but spaced therefrom to form a gap for passage of the strip out of said casing, a tongue integral with said third-mentioned portion of said casing and extending close to said second-mentioned downwardly extending portion of said cover but spaced therefrom to form a gap for continuing the passage of the remainder of the strip, said tongue having a shape corresponding to the shape of the bottom part of said flaps, and tear-off portions located on both sides of said tongue and extending from the base of said tongue laterally outwardly beyond the marginal edges of said strip arranged for the tear-off of the marginal portions of said strip,

4. The assembly of claim 3 wherein said other portions integral with said outwardly extending portion extends to a point below said tongue and said second guidance means.

5. A ticket dispensing assembly for dispensing tickets from a flexible strip comprising:

a container comprising a casing having side walls and an open top, and a covering pivotally connected to said casing and closing said top when in pivotally closed position, a roll of flexible strip material positioned in said container with the end of said strip protruding from said container, said strip roll comprising a strip of flexible material from which ticket pieces are intended to be torn off and having a pair of marginal edges and a feeding direction away from said roll, said strip having a series of longitudinally spaced apart punched lines, each of said punched lines shaped and adapted to form an individual tongue shaped flap free at one end from the remainder of said strip and firmly connected with said strip at the other end, each of said punched lines starting from a point adjacent to but spaced inwardly of said strip from one of said marginal edges, extending in said feeding direction of said strip and toward the centerline of said strip, and on the other side of said centerline extending back opposite said feeding direction of said strip to a point adjacent to but spaced inwardly from the other marginal edge of said strip, the points at the ends of each of said punched lines lying on a straight line which is substantially perpendicular to the longitudinal direction of said strip and with the connection of the adjacent flap to the strip located along said straight line between said points, the free end of each of said flaps having a width smaller than that of said connected portion and with the smaller end of each flap directed forwards in said feeding direction of said strip and dimensioned to be gripped for pulling the strip and tearing a single end piece from said strip, and marginal strip portions at both sides of each flap between the end points of said punched line and the adjacent marginal edges of said strip and connecting all of the ticket pieces in said strip, said covering having an outwardly extending portion and another portion integral with said first-mentioned outwardly extending portion and extending in a downwardly direction relative to said cover, said casing having a portion extending substantially parallel to said first-mentioned outwardly extending portion of said cover but spaced therefrom to form a gap for passage of the strip out of said casing, a tongue integral with said third-mentioned portion of said casing and extending close to said second-mentioned downwardly extending portion of said cover but spaced therefrom to form a gap for continuing the passage of the remainder of the strip, said tongue having a shape corresponding to the shape of the bottom part of said flaps, and tear-off portions located on both sides of said tongue and extending from the base of said tongue laterally outwardly beyond the marginal edges of said strip arranged for the tear-off of the marginal portions of said strip.

6. The assembly of claim 5 wherein said other portion integral with said outwardly extending portion extends to a point below said tongue and said second guidance means.

7. A ticket dispensing assembly for dispensing tickets from a flexible strip comprising:

a container comprising a casing and a cover pivotally connected with said casing and a roll of flexible strip material positioned in said container with the end of said strip protruding from said container and from which ticket pieces are intended to be torn off, said strip roll comprising a strip of flexible material from which ticket pieces are intended to be torn off and having a pair of marginal edges and a feeding direction way from said roll, said strip having a series of longitudinally spaced apart punched lines, each of said punched lines shaped and adapted to form an individual tongue shaped flap free at one end from the remainder of said strip and firmly connected with said strip at the other end, each of said punched lines starting from a point adjacent to but spaced inwardly of said strip from one of said marginal edges, extending in said feeding direction of said strip and toward the centerline of said strip, and on the other side of said centerline extending back opposite said feeding direction of said strip to a point adjacent to but spaced inwardly from the other marginal edge of said strip, the points at the ends of each of said punched lines lying on a straight line which is substantially perpendicular to the longitudinal direction of said strip and with the connection of the adjacent flap to the strip located along said straight line between said points, the free end of each of said flaps having a width smaller than that of said connected portion and with the smaller end of each flap directed forwards in said feeding direction of said strip and dimensioned to be gripped for pulling the strip and tearing a single end piece from said strip, and marginal strip portions at both sides of each flap between the end points of said punched line and the adjacent marginal edges of said strip and connecting all of the ticket pieces in said strip, first guidance means being combined with said cover, and second guidance and tear-off means being combined with said casing and including a separation tongue located at the strip exit point, said separation tongue having a shape corresponding to the shape of the bottom part of said flaps in order to, during passge of the strip in response to a pull on the end of said strip protruding from said assembly, first guide the strip along a predetermined path between said first and second guidance means and then guide the flap over said separation tongue along one path and the remainder of the strip along another path for tearing off the end ticket at said marginal portions of said strip and leaving the next adjacent flap protruding from the assembly.

* * * * *